US009441567B2

(12) United States Patent
Mahaveera et al.

(10) Patent No.: US 9,441,567 B2
(45) Date of Patent: Sep. 13, 2016

(54) METHOD AND DEVICE FOR DETECTING DIFFERENT EXHAUST GAS PROBE ERRORS DURING THE OPERATION OF AN INTERNAL COMBUSTION ENGINE

(71) Applicant: CONTINENTAL AUTOMOTIVE GMBH, Hannover (DE)

(72) Inventors: Harsha Mahaveera, Coventry (GB); Tino Arlt, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 29 days.

(21) Appl. No.: 14/348,671

(22) PCT Filed: Sep. 27, 2012

(86) PCT No.: PCT/EP2012/069020

§ 371 (c)(1),
(2) Date: Mar. 31, 2014

(87) PCT Pub. No.: WO2013/045522

PCT Pub. Date: Apr. 4, 2013

(65) Prior Publication Data

US 2014/0325960 A1 Nov. 6, 2014

(30) Foreign Application Priority Data

Sep. 29, 2011 (DE) ..... 10 2011 083 775

(51) Int. Cl.
*F02D 41/14* (2006.01)
*F02D 41/24* (2006.01)
*F02D 41/22* (2006.01)

(52) U.S. Cl.
CPC ..... *F02D 41/1473* (2013.01); *F02D 41/1439* (2013.01); *F02D 41/1454* (2013.01);

(Continued)

(58) Field of Classification Search
CPC ..... F02D 41/1454; F02D 41/1456; F02D 41/1495; F02D 2041/1431; F02D 2041/1432
See application file for complete search history.

(56) References Cited

U.S. PATENT DOCUMENTS 7,874,285 B2 1/2011 Barnikow et al. ..... 123/688
8,033,168 B2 10/2011 Katoh et al. ..... 73/114.75

(Continued)

FOREIGN PATENT DOCUMENTS

CN 101578434 A 11/2009 ..... B01D 53/94
CN 102052132 A 5/2011 ..... F01N 11/00

(Continued)

OTHER PUBLICATIONS

International Search Report and Written Opinion, Application No. PCT/EP2012/069020, 18 pages.

(Continued)

*Primary Examiner* — Jonathan Matthias
(74) *Attorney, Agent, or Firm* — Slayden Grubert Beard PLLC

(57) ABSTRACT

To operate an internal combustion engine, a specified forced stimulation is applied to an air ratio as the basis for a target value of a lambda controller. In diagnostic operation, a diagnostic function is used to identify a probe error of the exhaust gas probe, and a value of the measurement signal is recorded as a start value in chronological correlation with an edge of the target value curve of the lambda controller and the current value of the measurement signal is recorded as an end value after a specified first time duration. The start and end values are used to determine whether a filter error or a dead time error of the exhaust gas probe exists. The first time duration is specified such that start value/end value difference for a filter error differs start value/end value difference for a dead time error by at least a specified difference value.

6 Claims, 5 Drawing Sheets

(52) U.S. Cl.
CPC ..... *F02D41/1495* (2013.01); *F02D 41/2422* (2013.01); *F02D 41/1441* (2013.01); *F02D 41/1456* (2013.01); *F02D 2041/1431* (2013.01); *F02D 2041/1432* (2013.01); *F02D 2041/227* (2013.01)

(56) References Cited

U.S. PATENT DOCUMENTS

| | | | | |
|---|---|---|---|---|
| 8,504,278 | B2 | 8/2013 | Verner et al. | 701/109 |
| 2005/0216175 | A1 | 9/2005 | Takahashi et al. | 701/109 |
| 2008/0251057 | A1 | 10/2008 | Iwazaki | 123/690 |
| 2010/0242569 | A1 | 9/2010 | Kerns et al. | 73/1.06 |
| 2013/0269319 | A1 | 10/2013 | Rodatz et al. | 60/274 |

FOREIGN PATENT DOCUMENTS

| | | | |
|---|---|---|---|
| DE | 102006047190 | B3 | 4/2008 |
| DE | 102010063215 | B3 | 3/2012 |
| EP | 0402953 | A2 | 12/1990 |
| EP | 0569055 | A2 | 11/1993 |
| WO | 2013/045522 | A1 | 4/2013 |

OTHER PUBLICATIONS

Chinese Office Action, Application No. 201280047678.4, 14 pages.

METHOD AND DEVICE FOR DETECTING DIFFERENT EXHAUST GAS PROBE ERRORS DURING THE OPERATION OF AN INTERNAL COMBUSTION ENGINE

CROSS-REFERENCE TO RELATED APPLICATIONS

This application is a U.S. National Stage Application of International Application No. PCT/EP2012/069020 filed Sep. 27, 2012, which designates the United States of America, and claims priority to DE Application No. 10 2011 083 775.2 filed Sep. 29, 2011, the contents of which are hereby incorporated by reference in their entirety.

TECHNICAL FIELD

The invention relates to a method and a device for operating an internal combustion engine with an exhaust gas probe disposed in an exhaust tract of the internal combustion engine upstream of or in an exhaust gas catalyzer, whose measurement signal is characteristic of a residual oxygen content of the exhaust gas flowing past it.

BACKGROUND

Ever stricter legal regulations regarding the permissible harmful emissions of motor vehicles in which internal combustion engines are disposed make it necessary to keep the harmful emissions as low as possible during operation of the internal combustion engine. This can take place on the one hand by reducing the harmful emissions arising during the combustion of the air/fuel mixture in the respective cylinder of the internal combustion engine. On the other hand, exhaust aftertreatment systems that convert the harmful emissions produced during the combustion processes of the air/fuel mixture in the respective cylinders into harmless substances are used in internal combustion engines. For this purpose, exhaust gas catalyzers are used, which convert carbon monoxide, hydrocarbons and nitrogen oxides into harmless substances. Both the targeted influences on the generation of the harmful emissions during the combustion and also the high efficiency conversion of the harmful components by the exhaust gas catalyzer assume a very precisely adjusted air/fuel ratio in the respective cylinder. Moreover, there are ever stricter regulations regarding the diagnosis of components relevant to harmful substances. This e.g. also applies in respect of the exhaust gas probe disposed upstream of or in the exhaust gas catalyzer. Faulty behavior can occur with this, e.g. caused by contamination or deposits on the probe. A fault in the exhaust gas probe can cause significantly slower response behavior or even a significantly changed dead time. Without further measures there is the possibility in such a case that more harmful emissions are output into the environment.

SUMMARY

One embodiment provides a method for operating an internal combustion engine with an exhaust gas probe disposed in an exhaust tract of the internal combustion engine upstream of or in an exhaust gas catalyzer, whose measurement signal is characteristic of a residual oxygen content of the exhaust gas flowing past it, the method comprising: determining a target value of a lambda controller based on an air ratio subjected to a specified forcible excitation, determining an actuation signal of the lambda controller based on the measurement signal of the exhaust gas probe and the target value of the lambda controller, and in a specified diagnostic mode: using a specified diagnostic function to detect a probe error of the exhaust gas probe, and in response to detecting the probe error: detecting a value of the measurement signal time-correlated to an edge of the target value profile of the lambda controller as the starting value, and following a specified first time period detecting the current value of the measurement signal as the end value, and determining the existence of a filter error or a dead time error of the exhaust gas probe based on the starting value and the end value, wherein the first time period is specified such that the difference between the end value and the starting value corresponding to a filter error differs by at least a specified difference value from the difference between the end value and the starting value corresponding to a dead time error.

In a further embodiment, the specified diagnostic function comprises: detecting a value of the measurement signal time-correlated to an edge of the target value profile of the lambda controller as the starting value of the diagnostic function and, following a specified second time period, detecting the then-current value of the measurement signal as the end value of the diagnostic function, wherein the first time period is specified to be shorter than the second time period, and determining the presence of a probe error in the end value of the diagnostic function based on the starting value of the diagnostic function. In a further embodiment, an amplitude of the forcible excitation during the diagnostic mode is specified to be greater than outside of the diagnostic mode.

In a further embodiment, the method comprises in response to detecting a sensor error related to a detected dead time error, activating at least one of an associated dead time error controller parameter set and an associated dead time error model parameter set for the lambda controller, and in response to detecting a sensor error related to a detected filter error, activating at least one of an associated filter error controller parameter set and a filter error model parameter set for the lambda controller.

Another embodiment provides a device for operating an internal combustion engine with an exhaust gas probe disposed in an exhaust tract of the internal combustion engine upstream of or in an exhaust gas catalyzer, the probe having a measurement signal characteristic of a residual oxygen content of the exhaust gas flowing past it, wherein the device is configured to: determine a target value of a lambda controller based on an air ratio subjected to a specified forcible excitation, determine an actuation signal of the lambda controller based on the measurement signal of the exhaust gas probe and the target value of the lambda controller, and in a specified diagnostic mode: using a specified diagnostic function to determine the existence of a probe error of the exhaust gas probe, in response to detecting the probe error, detecting a value of the measurement signal time-correlated to an edge of the target value profile of the lambda controller as the starting value, and following a specified first time period, detecting the then-current value of the measurement signal as the end value, and determining the existence of a filter error or a dead time error of the exhaust gas probe based on the starting value and the end value, wherein the first time period is specified such that the difference between the end value and the starting value corresponding to a filter error differs by at least a specified difference value from the respective difference between the end value and the starting value corresponding to a dead time error.

BRIEF DESCRIPTION OF THE DRAWINGS

Example embodiments of the invention are explained in detail below using the schematic figures, in which.

DETAILED DESCRIPTION

Figure 1:
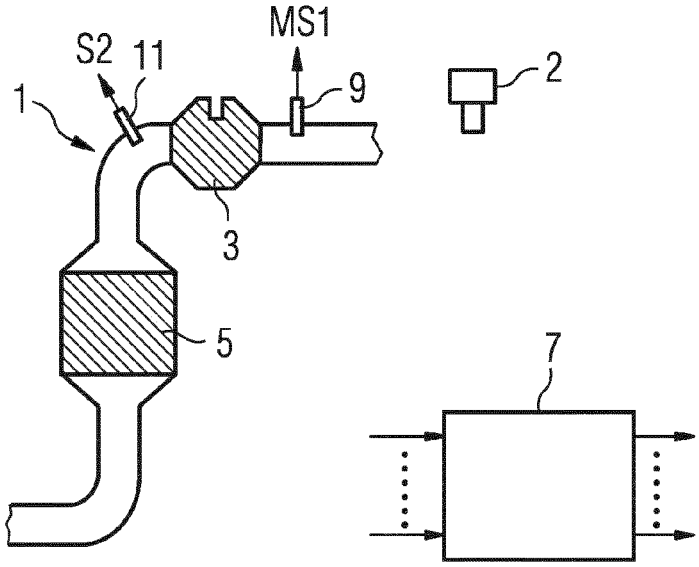
FIG. 1 shows an exhaust tract of an internal combustion engine and an associated control device.

Embodiments of the invention provide a method and a device for operating an internal combustion engine that make a contribution to the reliable low emission operation of the internal combustion engine.

Some embodiments provide a method and a corresponding device for operating an internal combustion engine with an exhaust gas probe disposed in an exhaust tract of the internal combustion engine upstream of or in an exhaust gas catalyzer, whose measurement signal is characteristic of a residual oxygen content of the exhaust gas flowing past it.

An air ratio is subjected to a specified forcible excitation that is specified as the basis for a target value of a lambda controller. A control signal of the lambda controller is determined depending on the measurement signal of the exhaust gas probe and the target value of the lambda controller.

In a specified diagnostic mode it is determined whether there is a probe error of the exhaust gas probe by means of a specified diagnostic function. It is thus determined by means of the diagnostic function whether the probe is operating without errors or whether there is generally a probe error.

If a probe error has been detected, a value of the measurement signal of the exhaust gas probe is detected in the diagnostic mode as a starting value that is time correlated to an edge of the target value profile of the lambda controller and following a specified first time period the current value of the measurement signal of the exhaust gas probe at that time is detected as the end value. Depending on the starting value and the end value, it is determined whether there is a filter error or a dead time error of the exhaust gas probe. The first time period is specified such that in the event of a filter error the respective difference of the end value and of the starting value differs at least by a specified difference value from the respective difference of the end value and of the starting value in the event of a dead time error.

This enables the filter error to be easily distinguished from the dead time error. In the event of the dead time error the response behavior of the exhaust gas probe has an at least specified increased dead time in comparison to a nominal exhaust gas probe, which e.g. is a reference probe. In the event of the filter error the response behavior of the exhaust gas probe is delayed at least as specified, especially in the sense of an increased time constant, and indeed in comparison to the nominal exhaust gas probe. By proceeding according to said embodiment, such a distinction between a filter error and a dead time error can be made simply and the respective error type correspondingly signaled or stored in an error memory or even used for further adjustment of the operation of the internal combustion engine.

According to one embodiment, the specified diagnostic function comprises the detection of a value of the measurement signal of the exhaust gas probe as a starting value of the diagnostic function time correlated to an edge of the target value profile of the lambda controller and, following a specified second time period, the detection of the current value of the measurement signal as the end value of the diagnostic function. The first time period is specified to be shorter than the second time period. The presence of a probe error will be detected or not depending on the starting value and the end value of the diagnostic function.

According to another embodiment, the amplitude of the forcible excitation during the diagnostic mode is specified to be greater than outside of the diagnostic mode. This enables a simple, particularly reliable diagnosis to be carried out, especially in relation to the difference between the dead time error and the filter error.

According to another embodiment, for a detected sensor error in the case of a detected dead time error an associated dead time error controller parameter set for the lambda controller is activated and in the event of a detected filter error an associated filter error controller parameter set and/or a filter model parameter set for the lambda controller is activated. This enables optimized operation of the lambda controller or the lambda control to be carried out in both error cases in relation to the respective error and thus especially the respective minimum harmful emissions to be guaranteed in both error cases.

The internal combustion engine comprises an induction tract, an engine block, a cylinder head and an exhaust tract 1 (FIG. 1). The induction tract preferably comprises a throttle flap as well as a collector and an intake manifold leading to a cylinder via an inlet channel in the engine block. The engine block further comprises a crankshaft, which is coupled by means of a connecting rod to a piston of the cylinder.

The cylinder head comprises a valve drive with a gas inlet valve and a gas exhaust valve. It further comprises an injection valve 2 and preferably an ignition plug. Alternatively, the injection valve 2 can also be disposed in an intake manifold.

In the exhaust tract 1 an exhaust gas catalyzer 3 is disposed, which is preferably in the form of a three-way catalyzer. Furthermore, another exhaust gas catalyzer 5 is optionally disposed in the exhaust tract 1, being in the form of an NOX catalyzer.

A control device 7 is provided, with which sensors are associated that detect various measurement variables and respectively determine the value of the measurement variable. The control device 7 is designed to determine control variables depending on at least one of the measurement variables, which are then converted into one or more control signals for controlling the actuators, especially for controlling their actuating drives, which act on actuating elements of the actuators.

The control device 7 can also be referred to as a device for operating the internal combustion engine.

The sensors are a pedal position sensor, an air flow sensor, which detects an air flow upstream of the throttle flap, a temperature sensor, which detects an induction air temperature, an intake manifold pressure sensor, a crankshaft angle sensor, which detects a crankshaft angle of a crankshaft and with which a revolution rate N is then associated.

Furthermore, an exhaust gas probe 9 is provided, which is disposed upstream of the exhaust gas catalyzer 3 or possibly even in the exhaust gas catalyzer 3. The measurement signal MS1 of the exhaust gas probe 9 is representative of a residual oxygen content of the exhaust gas flowing past it and is thus characteristic of the air/fuel ratio in the combustion chamber of the cylinder and upstream of the exhaust gas probe 9 prior to the oxidation of the fuel and is thus representative of a detected air ratio LAM_AV.

Downstream of the exhaust gas probe 9, another exhaust gas probe 11, which likewise detects a residual oxygen content of the exhaust gas flowing past it, may be disposed in or downstream of the exhaust gas catalyzer 3. The measurement signal of the exhaust gas probe 11 is referred to as MS2. The exhaust gas probe 9 is preferably a linear lambda probe. The further exhaust gas probe 11 is preferably a binary lambda probe, but in principle can also be a linear lambda probe. The same applies to the exhaust gas probe 9.

Depending on the embodiment, any subset of said sensors can be provided or additional sensors can also be provided. The actuating elements are e.g. the throttle flap, the gas inlet and gas exhaust valves, the injection valve 2 or the ignition plug. The internal combustion engine may of course comprise a plurality of cylinders, with which corresponding actuating drives and sensors may be associated.

Figure 2:
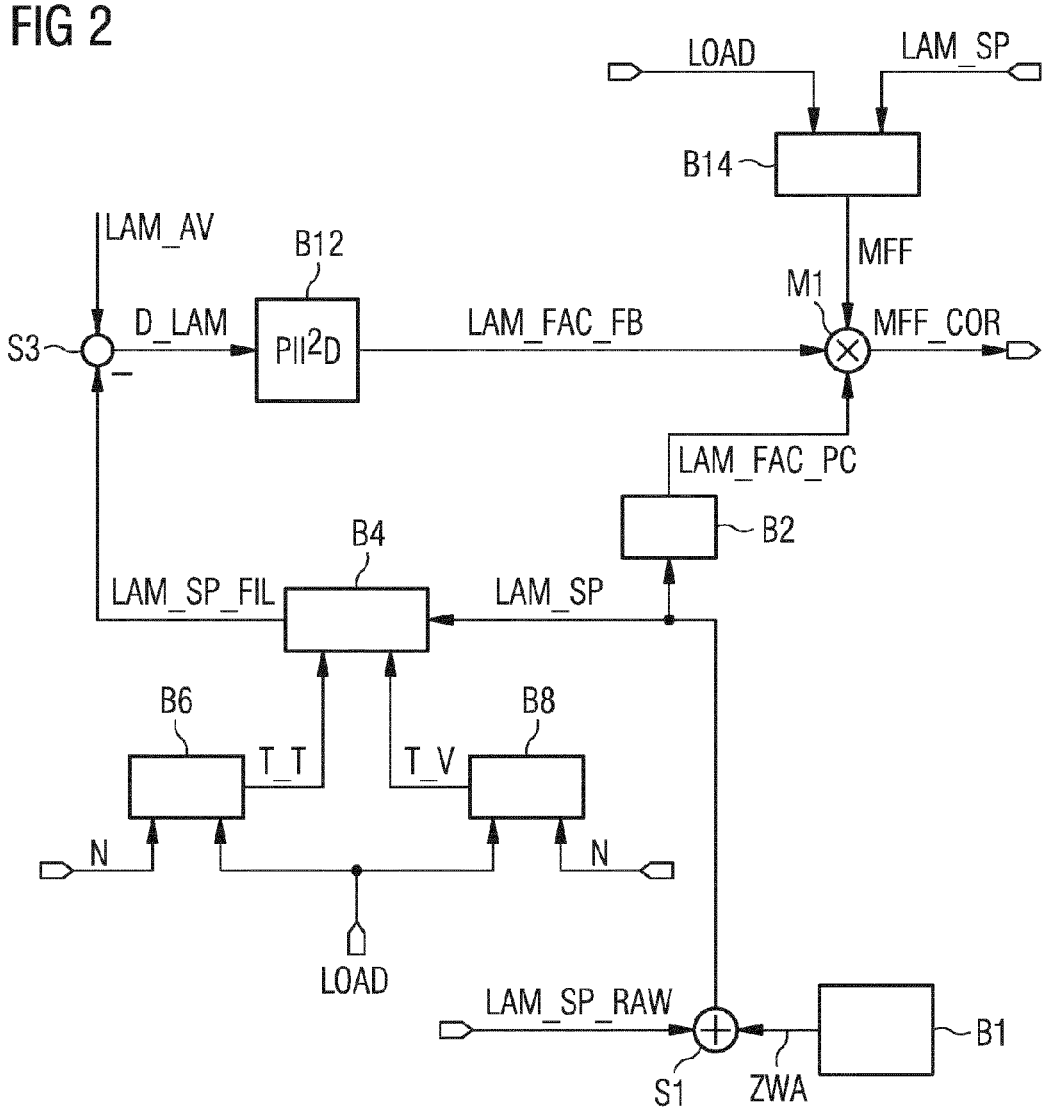
FIG. 2 shows a block diagram of a lambda controller, which is especially formed in the control device.

A block diagram of a lambda controller, which is formed by means of the control device 7, is illustrated in FIG. 2.

A specified air ratio LAM_SP_RAW can be specified as a fixed value for normal operation in a particularly simple embodiment. It is preferably determined e.g. depending on the current operating mode of the internal combustion engine, such as homogenous or layered mode and/or depending on operating variables of the internal combustion engine.

A block B1 is designed to determine a forcible excitation ZWA that is preferably in the form of a periodic rectangular signal oscillating about a neutral value. A specified forcibly stimulated air ratio LAM_SP is provided at a summation point S1 on the output side.

The specified forcibly stimulated air ratio LAM_SP is fed to a block B2, which contains a pilot controller and produces a pilot lambda factor LAM_FAC_PC depending on the specified forcibly stimulated air ratio LAM_SP.

In a block B4 a filter is formed and is especially based on a system model, by means of which the specified forcibly stimulated air ratio LAM_SP is filtered and a target value of a lambda controller LAM_SP_FIL is thus produced.

A block B6 is provided, whose input variables are a revolution rate N and/or a load LOAD. The load can e.g. be represented by the intake manifold pressure or even the air flow MAF. The block B6 is designed to determine a dead time T_T, depending on the revolution rate N and/or the load LOAD. For this purpose, a characteristic field can be stored, e.g. in the block B6, and the dead time T_T can be determined by means of characteristic field interpolation.

Furthermore, a block B8 is provided, whose input variables are the revolution rate N and/or the load LOAD. The block B8 is designed to determine a delay time T_V depending on its input variables and indeed preferably by means of a characteristic field interpolation using a characteristic field stored in the block B8. The characteristic fields are preferably previously determined by experiments or simulations.

The dead time T_T and also the delay time T_V are characteristic of a gas transition time that passes between a point in time relevant to metering fuel and a correlating profile of the measurement signal MS1 at the exhaust gas probe 9. The dead time T_T and/or the delay time T_V are preferably input variables of the block B4 and thus of the filter.

The filter preferably comprises a Padé filter. Moreover, the block B4 preferably also comprises a low pass filter, which especially approximates to the behavior of the exhaust gas probe 9 depending on the delay time T_V.

A detected air ratio LAM_AV, which is determined depending on the measurement signal MS1 of the exhaust gas probe 9, is fed to a third summation point S3. Depending on the target value LAM_SP_FIL of the lambda controller and the detected air ratio LAM_AV, a control difference D_LAM is determined in the third summation point by forming a difference.

The control difference D_LAM is the input variable of a block B12, in which the lambda controller is formed and in fact preferably as a $PII^2D$ controller. The actuation signal of the lambda controller of the block B12 is e.g. a lambda control factor LAM_FAC_FB.

Furthermore, a block B14 is provided in which a fuel quantity to be dispensed MFF is determined depending on a load LOAD and the specified forcibly stimulated air ratio LAM_SP. Preferably, the load LOAD is in this case an air flow flowing into the respective combustion chamber of the respective cylinder per working cycle.

In a multiplier stage M1 a corrected fuel quantity to be dispensed MFF_COR is determined by forming the product of the fuel quantity to be dispensed MFF, the pilot lambda control factor LAM_FAC_PC and the lambda control factor LAM_FAC_FB. The injection valve 2 is correspondingly controlled to dispense the corrected fuel quantity to be dispensed MFF_COR.

The control device 7 comprises a program memory and a data memory and a computation unit, in which a plurality of programs, which are stored in the program memory, are executed during the operation of the internal combustion engine.

Figure 3:
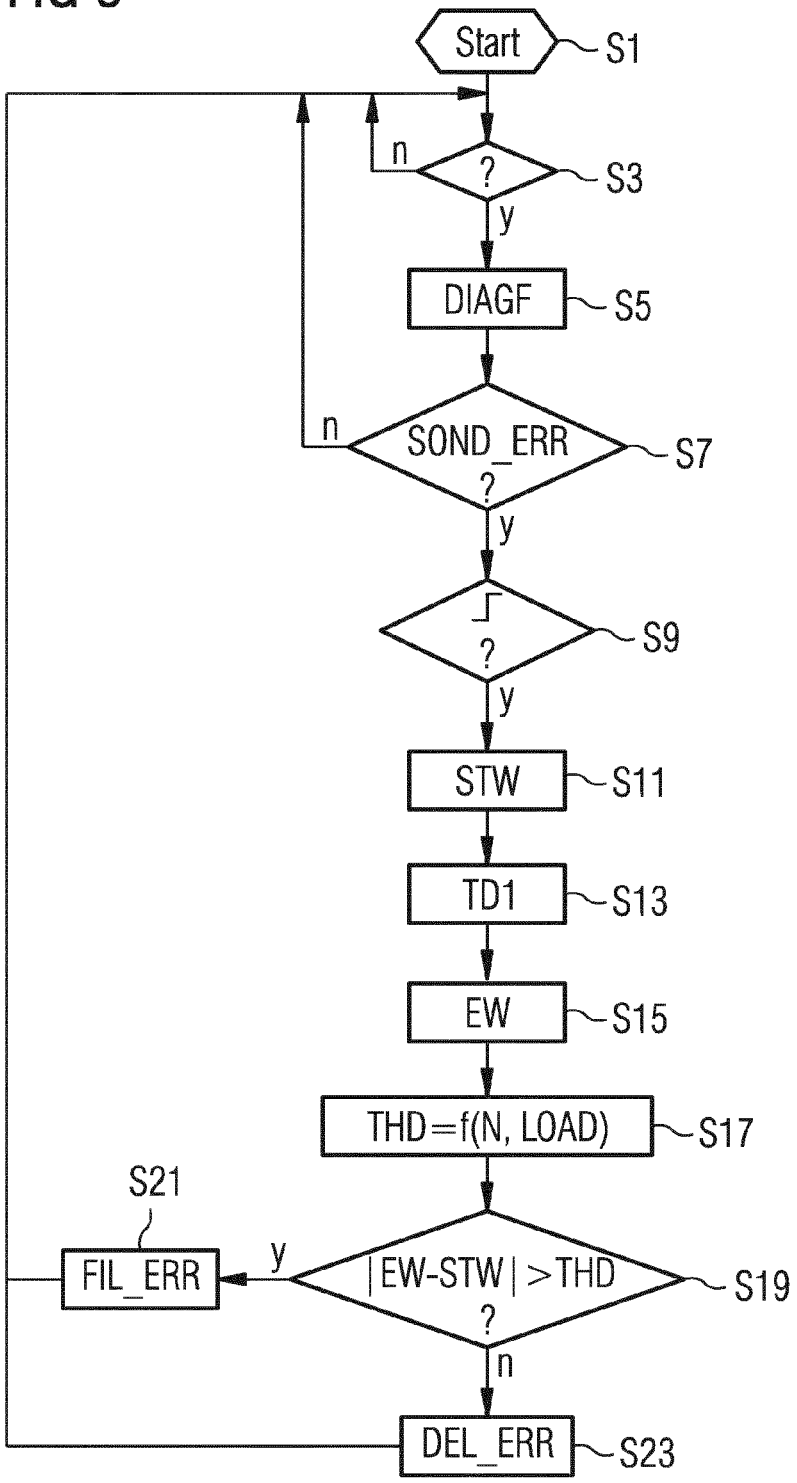
FIG. 3 shows a flow chart of a program.

A flow chart of a program is illustrated in detail using FIG. 3. The program is started in a step S1, in which variables may be initialized. In a step S3 a check is made as to whether the internal combustion engine is currently being operated in a specified operating range, which e.g. can be a lower partial load range with e.g. a maximum revolution rate of approximately 2500 revolutions per minute. Furthermore, in step S3 a check is made as to whether at least one other condition is fulfilled, which e.g. is fulfilled if a quasi-stationary operating state exists and/or a specified time period has expired since a last completion of a diagnostic mode and/or whether a specified distance travelled has been covered since the last completion of the diagnostic mode. If the conditions of step S3 are fulfilled, then a diagnostic mode is adopted and the processing continues in a step S5. If not, the processing is continued again in step S3, possibly following a specified waiting period.

In step S5 a diagnostic function DIAGF is carried out, by means of which it is determined whether there is a probe error SOND_ERR of the exhaust gas probe 9. Subsequently, the processing is continued in a step S7, in which, if there is no probe fault SOND_ERR, then the processing is again continued in step S3, possibly after the specified waiting period.

Otherwise, following step S7 the processing continues in a step S9. In step S9 the further processing is delayed until an edge of the target value profile of the target value LAM_SP_FIL of the lambda controller is detected. This can in principle be a rising or a falling edge.

Time-correlated to the detected edge of the target value profile of the target value LAM_SP_FIL, i.e. especially immediately thereafter, in a step S11 a value of the measurement signal MS1 of the exhaust gas probe 9 is detected as a starting value STW, wherein this can be the respectively detected air ratio LAM_AV. A timer is then started in a step S13, which expires following a specified first time period TD1. Following expiry of the timer the processing continues in the step S15, in which the current value at that time of the measurement signal MS1 of the exhaust gas probe 9 is determined as the end value EW, wherein this can especially again be the current detected air ratio LAM_AV at that time.

In a step S17 a threshold value THD is determined, which can be specified as a fixed value in a simple embodiment, but can also be determined depending on at least one variable, especially by means of a characteristic field. For this purpose, e.g. a corresponding characteristic field is provided, by means of which the threshold value THD is determined depending on the revolution rate N and/or a load LOAD. The load can e.g. be represented by an air flow and/or an intake manifold pressure.

In a step S19 a check is made as to whether a magnitude deviation between the end value EW and the starting value STW is greater than the threshold value THD. If this is the case then a filter error FIL_ERR is detected and this happens in the step S21, and if not a dead time error DEL_ERR is detected in a step S23.

The first time period TD1 is specified such that for the case of the filter error FIL_ERR the respective difference of the end value EW and of the starting value STW differs at least by a specified difference value from the respective difference of the end value EW and of the starting value STW for the case of the dead time error DEL_ERR.

Following step S21 or S23, the processing is continued again in step S3, possibly following a specified waiting period.

During the diagnostic mode, i.e. from the processing of the step S5 up to step S7 if the condition is not fulfilled, and otherwise up to the processing of steps S21 or S23, the amplitude of the forcible excitation ZWA is specified to be greater than outside of the diagnostic mode. The amplitude of the forcible excitation in the diagnostic mode can e.g. be twice to 3 times or 4 times as large in comparison to the other mode.

When carrying out the diagnostic function DIAGF in step S5, a value of the measurement signal MS1 is detected as a starting value of the diagnostic function, e.g. time-correlated to an edge of the target value profile of the target value of the lambda controller. Following a specified second time period, the current value of the measurement signal MS1 of the exhaust gas probe 9 at that time is detected as the end value of the diagnostic function. The first time period TD1 is specified to be shorter than the second time period. Depending on the starting value and the end value of the diagnostic function, the existence of the probe error SOND_ERR is detected or not detected.

The first time period TD1 is especially specified to be significantly shorter than the second time period. The second time period is specified in this connection e.g. such that when it expires, for a nominal exhaust gas probe the value of the measurement signal and especially of the detected air ratio LAMV is in a very narrow range close to the target value of the lambda controller LAM_SP_FIL, and by contrast the detected air ratio LAM_AV is still significantly different therefrom both in the event of a filter error FIL_ERR and also in the event of a dead time error DEL_ERR.

Preferably, in the event of a detected dead time error DEL_ERR an associated dead time error controller parameter set and/or a dead time error model parameter set for the lambda controller is activated. The same applies in the event of a detected filter error FIL_ERR, in which case an associated filter error controller parameter set for the lambda controller is activated and/or an associated filter error model parameter set for the lambda controller is activated. In this connection the respective controller parameter set especially comprises the controller parameters of the lambda controller. The model parameter set especially relates to the parameters of the system model of the filter of block B4. They can thus e.g. comprise the output variables of blocks B6 and B8. The control parameters and also the model parameters are thereby each applied in relation to an expected profile of the measurement signal MS1 in response to an edge of the target value profile of the lambda controller and this is especially done while taking into account at least one specified quality criterion and corresponding optimization of said quality criterion.

For the operation of the lambda controller in the event of an undetected probe error of the exhaust gas probe 9, both the controller parameters and also the model parameters are applied in relation to a measurement signal behavior of the nominal exhaust gas probe. In the event of a dead time error, the controller parameters of the dead time error controller parameter set or the model parameters of the dead time error model parameter set for the expected measurement signal behavior of such an exhaust gas probe with a dead time error are applied. In the event of a filter error the controller parameters of the filter error controller parameter set or the model parameters of the filter error model parameter set for the expected measurement signal behavior of such an exhaust gas probe with a filter error are applied.

Figure 4:
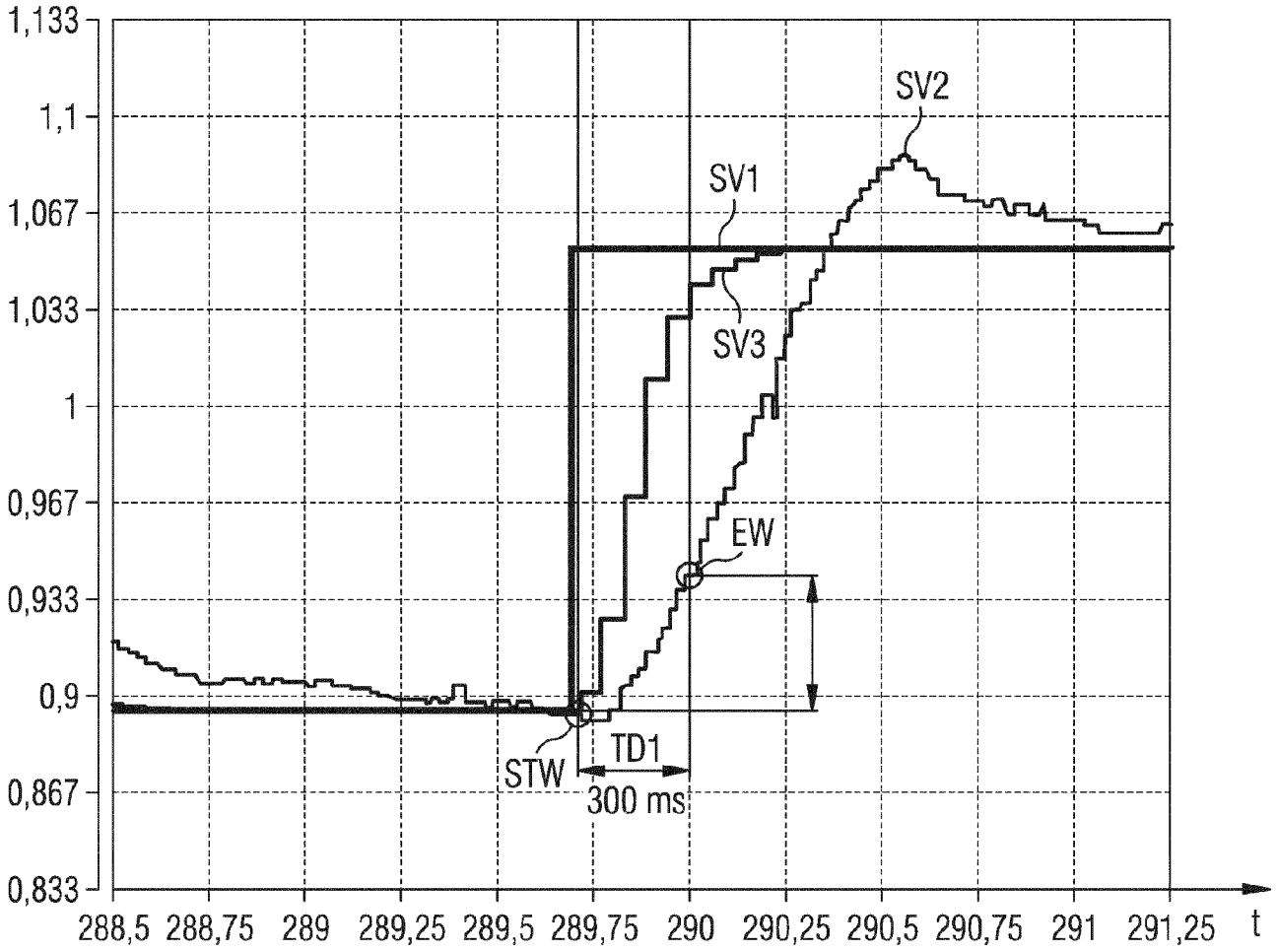
FIG. 4 shows a first signal profile plotted against time t and FIG. 5 shows a second signal profile plotted against time t.

In FIG. 4 various signal profiles are plotted against time t. A first signal profile SV1 thereby represents a profile of the target value LAM_SP_FIL of the lambda controller and SV2 represents the signal profile of the detected air ratio LAM_AV for the case of an exhaust gas probe 9 with a filter error. A signal profile SV3 represents the signal profile of the detected air ratio LAM_AV for the nominal exhaust gas probe.

Figure 5:
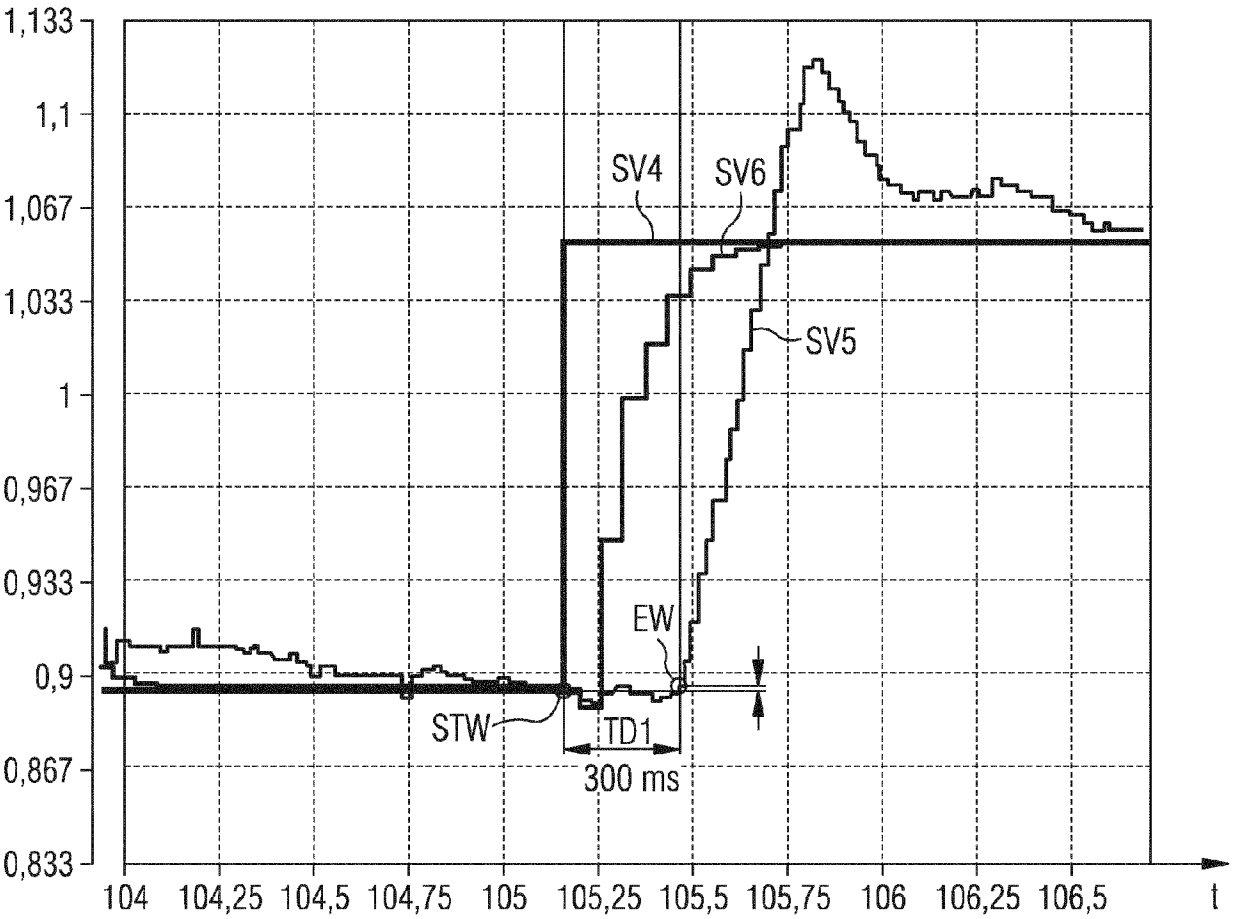

In FIG. 5 signal profiles are likewise plotted against time t. SV4 represents the profile of the target value LAM_SP_FIL of the lambda controller here. SVS represents the profile of the detected air ratio LAM_AV in the event that the exhaust gas probe 9 has a dead time error DEL_ERR. SV6 represents the profile of the detected air ratio LAM_AV for the nominal exhaust gas probe.

A contribution is made by the above-mentioned procedure to increasing the service life of the individual components, thus e.g. of the exhaust gas probe 9 and/or of the exhaust gas catalyzer 3.

What is claimed is:

1. A method for operating an internal combustion engine with an exhaust gas probe disposed in an exhaust tract of the internal combustion engine upstream of or in an exhaust gas catalyzer, whose measurement signal is characteristic of a residual oxygen content of the exhaust gas flowing past it, the method comprising:

calculating a target value of a lambda controller based on an air ratio subjected to a specified forcible excitation, sensing the measurement signal from the exhaust gas probe, calculating an actuation signal of the lambda controller based on the measurement signal of the exhaust gas probe and the target value of the lambda controller, in a specified diagnostic mode, using a specified diagnostic function to detect a probe error of the exhaust gas probe, and in response to detecting the probe error, detecting a value of the measurement signal time-correlated to an edge of a target value profile of the lambda controller as a starting value, and following a specified first time period detecting a current value of the measurement signal as an end value, and identifying the probe error as one of either a filter error or a dead time error of the exhaust gas probe based on the starting value and the end value, wherein the first time period is specified such that the difference between the end value and the starting value corresponding to a filter error differs by at least a specified difference value from the difference between the end value and the starting value corresponding to a dead time error, and in response to detecting a dead time error, activating at least one of an associated dead time error controller parameter set and an associated dead time error model parameter set for the lambda controller, and in response to detecting a filter error, activating at least one of an associated filter error controller parameter set and a filter error model parameter set for the lambda controller, adjusting operation of the internal combustion engine based at least in part on the activated parameter set.

2. The method of claim 1, wherein the specified diagnostic function comprises:

detecting a value of the measurement signal time-correlated to an edge of the target value profile of the lambda controller as the starting value of the specified diagnostic function and, following a specified second time period, detecting the then-current value of the measurement signal as the end value of the specified diagnostic function, wherein the first time period is specified to be shorter than the second time period, and determining the presence of the probe error in the end value of the specified diagnostic function based on the starting value of the specified diagnostic function.

3. The method of claim 1, wherein a forcible excitation during the diagnostic mode is specified to be greater than outside of the diagnostic mode.

4. A device for operating an internal combustion engine with an exhaust gas probe disposed in an exhaust tract of the internal combustion engine upstream of or in an exhaust gas catalyzer, the probe measuring a residual oxygen content of the exhaust gas flowing past it, the device comprising a program memory storing a set of executable instructions;

a data memory for storing sensed measurements and determined values; and a computation unit accessing the program memory and the data memory, executing the set of executable instructions to:

determine a target value of a lambda controller based on an air ratio subjected to a specified forcible excitation, receive a measurement signal from the exhaust gas probe, determine an actuation signal of the lambda controller based on the measurement signal received from the exhaust gas probe and the target value of the lambda controller, and in a specified diagnostic mode:

using a specified diagnostic function to determine the existence of a probe error of the exhaust gas probe, in response to detecting the probe error, calculate a value of the measurement signal time-correlated to an edge of a target value profile of the lambda controller as a starting value, and following a specified first time period, store a then-current value of the measurement signal as the end value, and identify the probe error as either a filter error or a dead time error of the exhaust gas probe based on the starting value and the end value, wherein the first time period is specified such that the difference between the end value and the starting value corresponding to a filter error differs by at least a specified difference value from the respective difference between the end value and the starting value corresponding to a dead time error, and in response to detecting a dead time error, activate at least one of an associated dead time error controller parameter set and an associated dead time error model parameter set for the lambda controller, and in response to detecting a filter error, activate at least one of an associated filter error controller parameter set and a filter error model parameter set for the lambda controller, adjust operation of the internal combustion engine based at least in part on the activated parameter set.

5. The device of claim 4, wherein the specified diagnostic function comprises:

detecting a value of the measurement signal time-correlated to an edge of the target value profile of the lambda controller as the starting value of the specified diagnostic function and, following a specified second time period, detecting the then-current value of the measurement signal as the end value of the specified diagnostic function, wherein the first time period is specified to be shorter than the second time period, and determining the presence of the probe error in the end value of the specified diagnostic function based on the starting value of the specified diagnostic function.

6. The device of claim 4, wherein a forcible excitation during the diagnostic mode is specified to be greater than outside of the diagnostic mode.

* * * * *